US005221245A

United States Patent [19]

Yeh

[11] Patent Number: 5,221,245

[45] Date of Patent: Jun. 22, 1993

[54] MULTIFUNCTION EXERCISE APPARATUS

[76] Inventor: Jonathan Yeh, No. 77-3, Nanshih Village, Linkou Hsiang, Taipei County, Taiwan

[21] Appl. No.: 828,579

[22] Filed: Jan. 31, 1992

[51] Int. Cl.[5] ..... A63B 21/062

[52] U.S. Cl. ..... 482/138; 482/99; 482/102

[58] Field of Search ..... 482/94, 97-103, 482/133, 135-138, 142, 908

[56] References Cited

U.S. PATENT DOCUMENTS

| | | | |
|---|---|---|---|
| 1,547,268 | 7/1925 | Sotomayor | 482/908 X |
| 4,256,302 | 3/1981 | Keiser et al. | 482/100 |
| 4,546,970 | 10/1985 | Mahnke | 482/138 X |
| 4,709,920 | 12/1987 | Schnell | 482/100 |
| 4,776,582 | 10/1988 | Ramhorst | 482/908 X |
| 4,900,018 | 2/1990 | Ish, III et al. | 482/138 |
| 4,982,955 | 1/1991 | Heasley | 482/100 |
| 4,982,956 | 1/1991 | Lapcevic | 482/100 |
| 5,120,289 | 6/1992 | Yu | 482/138 X |

FOREIGN PATENT DOCUMENTS

| | | | |
|---|---|---|---|
| 2656534 | 6/1978 | Fed. Rep. of Germany | 482/133 |
| 3445104 | 6/1986 | Fed. Rep. of Germany | 482/137 |
| 7609655 | 3/1978 | Netherlands | 482/103 |

*Primary Examiner*—Robert Bahr

*Attorney, Agent, or Firm*—Morton J. Rosenberg; David I. Klein

[57] ABSTRACT

Multifunction exercise apparatus which uses only a single weight. A frame supports various exercising stations which exercise different muscle groups. A resistance-adjusting assembly adjusts a level of resistance in conjunction with the weight needed to be overcome in manipulation of the exercising station. The resistance-adjusting assembly defines a moment arm and an axis of rotation and then varies the moment arm to vary a level of resistance. The assembly includes an elongated body portion with a plurality of moment arms defined thereon and a pair of pulleys attached thereto, a cable attached to the exercising stations, and apparatus to connect the body portion to the weight.

1 Claim, 7 Drawing Sheets

MULTIFUNCTION EXERCISE APPARATUS

BACKGROUND OF THE INVENTION

1. Field of the Invention

The present invention relates to exercise machines and, more particularly, to multifunction exercise machines which use a number of pulleys and cables to move weight.

2. Description of Related Art

Conventional multifunction exercise machines have a number of exercise stations by which a user manipulates to exercise a particular muscle group, e.g., legs, chest, back, arms, and shoulders. The exercise stations have some type of movable structure attached to a cable which runs over any number of pulleys and is fixed to a bar with a number of pin holes disposed vertically through a stack of weights. To adjust the amount of weight to be used, a pin is inserted into a pin hole under the desired weight. The stack of weights typically comprises from one to 15 or more 10-pound weights.

A disadvantage of this exercise machine is that it is extremely heavy, rendering it immovable once assembled. The majority of the overall weight is due to the stack of weights. The stack of weights also increases shipping costs to a high degree.

Therefore, there is a need in the related art for an exercise machine which offers a user variable resistances but does not employ a variable stack of weights in doing so.

SUMMARY OF THE INVENTION

The present invention provides a multifunction exercise machine which uses only one weight. A resistance-adjusting means is employed in conjunction with the weight to vary levels of resistance needed to be overcome for a user to manipulate various exercising means disposed on the apparatus. The resistance-adjusting means consists of a cable, pulleys, and an elongated body portion with an axis of rotation defined thereon. A moment means is disposed on the body portion and has a plurality of different settings to vary a moment arm defined by the body portion and the axis of rotation. In varying the moment arm, the weight remains constant while the force needed to move the weight respectively varies, thereby defining levels of resistance.

Accordingly, it is a primary object of the present invention to provide a multifunction exercise apparatus which eliminates the need for a stack of weights to vary levels of resistance.

It is another object of the present invention to provide a multifunction exercise apparatus with a resistance-adjusting means which varies levels of resistance in conjunction with a single weight.

It is still another object of the present invention to provide a multifunction exercise apparatus which varies levels of resistance by varying a moment arm about an axis of rotation.

These and additional objects will become apparent to those who are skilled in the art upon reading the following detailed description with reference to the accompanying drawings.

DETAILED DESCRIPTION OF THE PREFERRED EMBODIMENT

Figure 1:
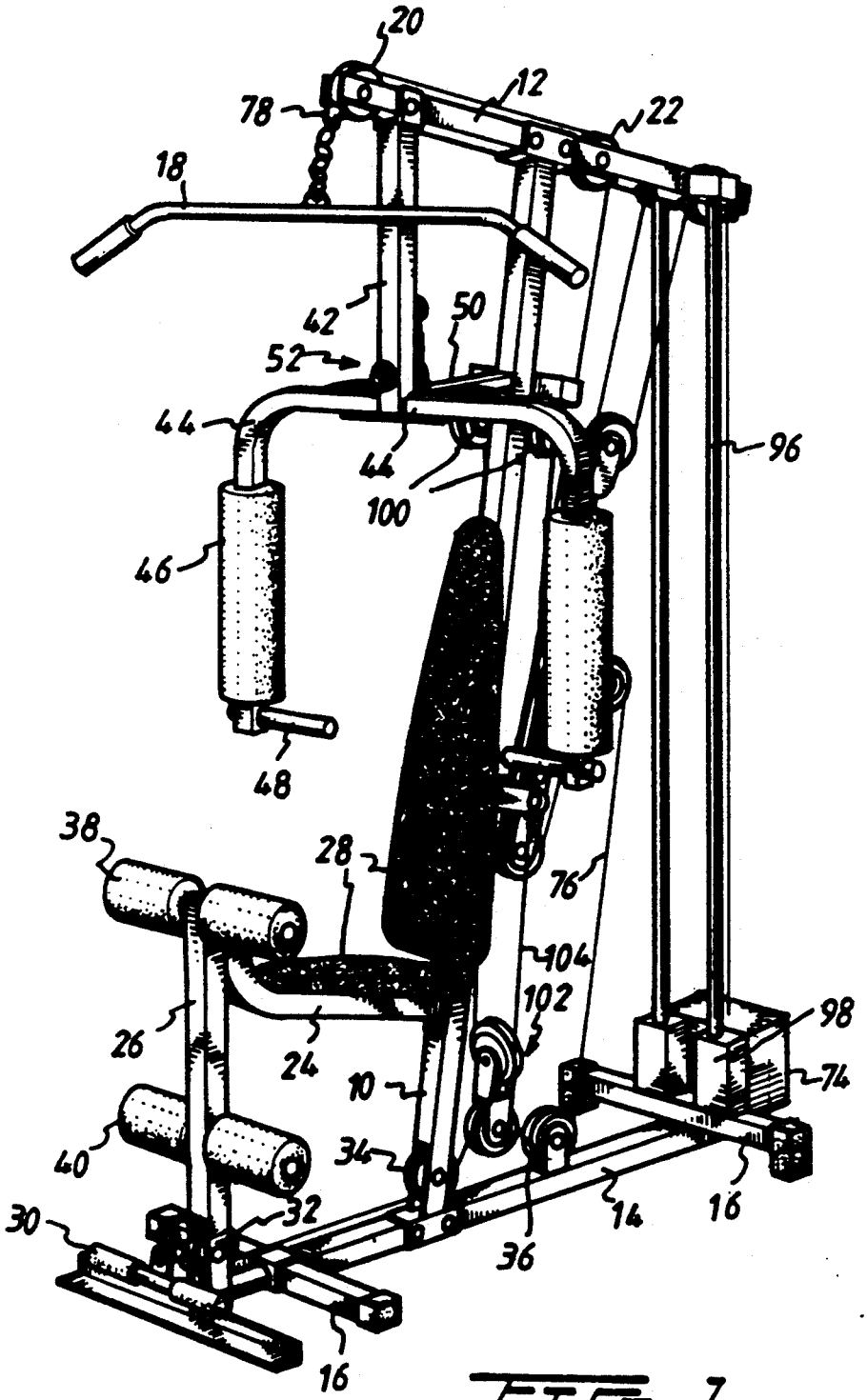
FIG. 1 is a perspective view of a multifunction exercise apparatus shown in a preferred embodiment in accordance with the present invention.

Referring to the drawings, initially to FIG. 1, a multifunction exercise machine is shown in a preferred embodiment in accordance with the present invention and generally comprises a frame, a weight, three different exercising means which are disposed on the frame for manipulation by a user to exercise different muscle groups of the body, and a resistance-adjusting means which is attached to the weight and the exercising means and disposed on the frame. The resistance-adjusting means adjusts a level of resistance, in conjunction with the weight, needed to be overcome by the user to manipulate the exercising means.

Figure 2:
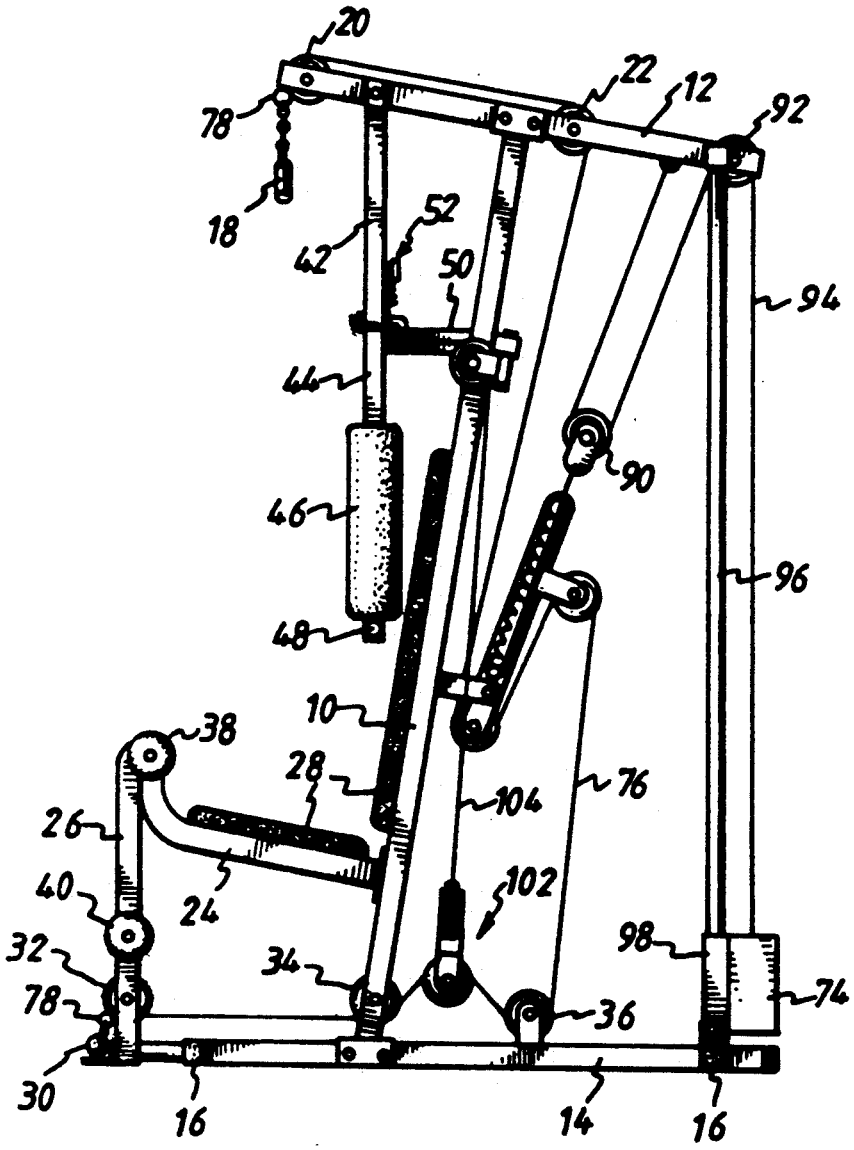
FIG. 2 is a side plan view of the exercise apparatus.

With additional reference to FIG. 2, more specifically the frame comprises a substantially vertical primary support 10, a substantially horizontal top support 12 which is fixed to a top of the primary support, a floor support 14 which is fixed to a bottom of the primary support and rest on a floor, and a pair of transverse supports 16 which are fixed substantially perpendicular to the floor support and provide lateral support to the frame.

The exercising means comprises an upper exercising means which is disposed on the top support 12, a lower exercising means which is disposed on a lower portion of the primary support 10, and a pectoral exercising means which is disposed on the primary support 10 and the top support 12.

More specifically, the upper exercising means comprises an upper bar 18 which has a suitable length for human manipulation, a first upper pulley 20 which is disposed on the top support 12 at a front end thereof, and a second upper pulley 22 which is disposed on the top support 12 at a position rearward to where the primary support 10 is fixed thereto.

The lower exercising means comprises a first brace 24 which is fixed to the primary support 10 on a front side thereof, a second brace 26 which has a first end thereof pivotally attached to the first brace 24 and a second end thereof contacting the bottom support 14, thereby preventing rearward movement thereof, a seat 28 which is disposed on the second brace 26 and on the front side of the primary support 10, a lower bar 30 which has a suitable length for human manipulation, a first lower pulley 32 which is disposed on the second brace 26 at a lower portion thereof, a second lower pulley 34 which is disposed on the primary support 10 at the lower portion thereof, and a third lower pulley 36 which is disposed on the bottom support 14 at a distance from where the primary support 10 is fixed thereto. A first pair of body supports 38 is attached to the pivotal junction of the first brace 24 and the second brace 26, and a second pair of body supports 40 is attached on the second brace 26 at a lower portion thereof.

The pectoral exercising means comprises a main bar 42 which is pivotally attached to the top support 10 at a front portion thereof, a pair of butterfly bars 44 which is pivotally attached to a bottom end of the main bar 42, each extending therefrom in opposite lateral directions and having padding 46 on downward portions thereof and handles 48 at bottom portions thereof, a stop brace 50 which is fixed to the primary support 10 and extends therefrom to the bottom end of the main bar 42, a locking means 52 which is disposed on the main bar 42 at a lower portion thereof for locking the main bar 42 to the stop brace 50, and a linking means for linking the butterfly bars 44 to the resistance-adjusting means, which will be discussed later.

Figure 3:
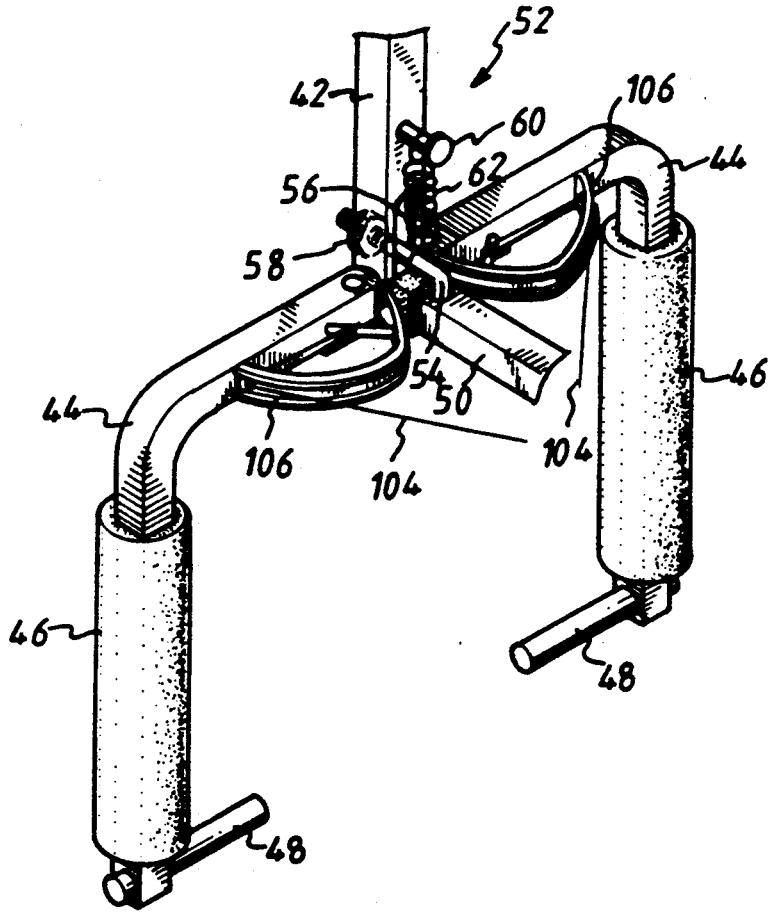
FIG. 3 is a perspective view of pectoral exercising means in accordance with the present invention.
Figure 4:
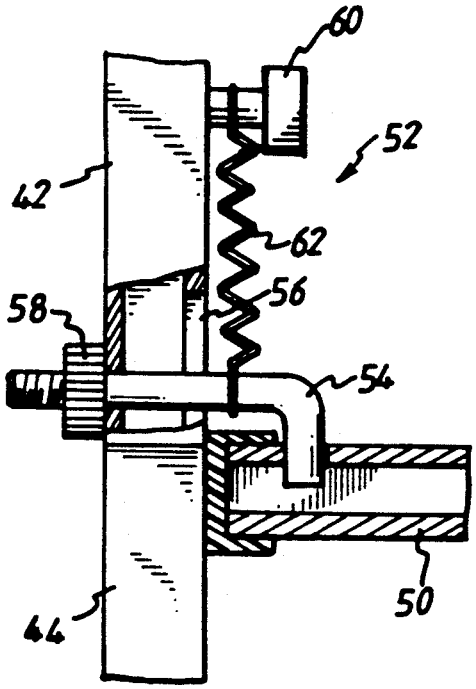
FIG. 4 is a partially cross-sectional view of a locking means of the pectoral exercising means.

With further reference to FIGS. 3 and 4, the locking means comprises an L-shaped pin 54 disposed through a slot 56 formed in the bottom portion of the main bar 42 and retained in a hole of the stop brace 50. A knob 58 is disposed on a threaded end of the L-shaped pin 54. A retaining pin 60 is fixed to the main bar 42, and a spring 62 is stretched between the retaining and the L-shaped pin 60 and 54. When the knob 58 is tightened as shown and a user pushes outward on the paddings 46, the butterfly bars 44 pivot outward. And when the knob 54 is loosened, the spring 62 draws the L-shaped pin 54 upward, thereby releasing the main bar 42 from the stop brace 50, such that when a user pushes outward on the handles 48, the main bar 42 along with the butterfly bars 44 pivots outward.

Figure 5:
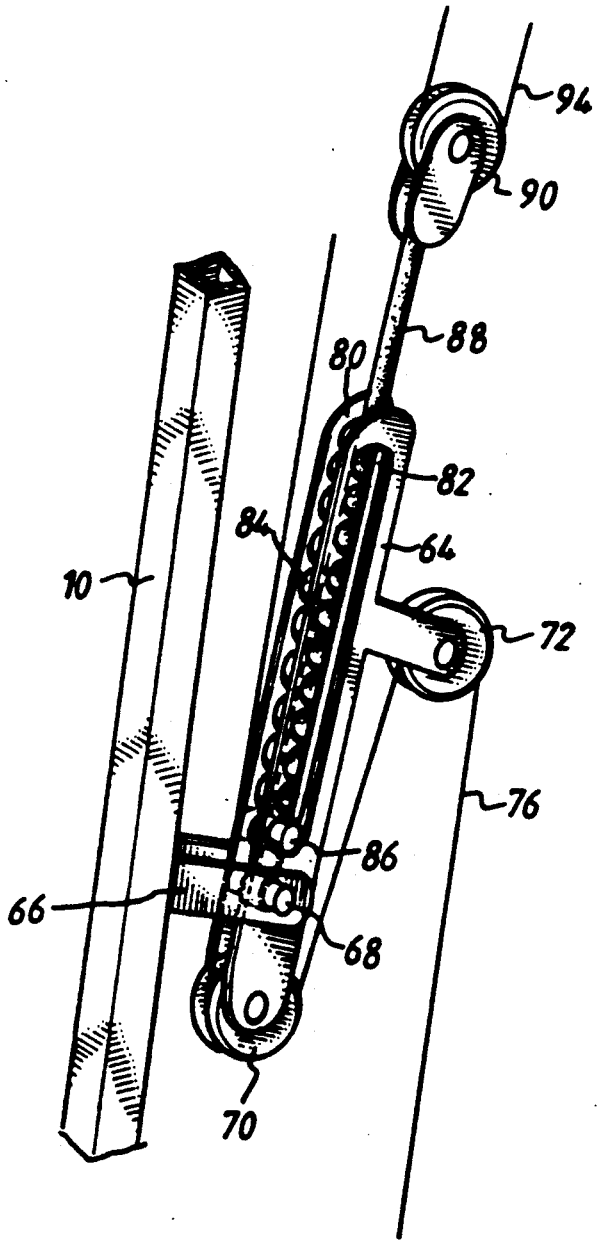
FIG. 5 is a perspective view of a resistance-adjusting means in accordance with the present invention.
Figure 6:
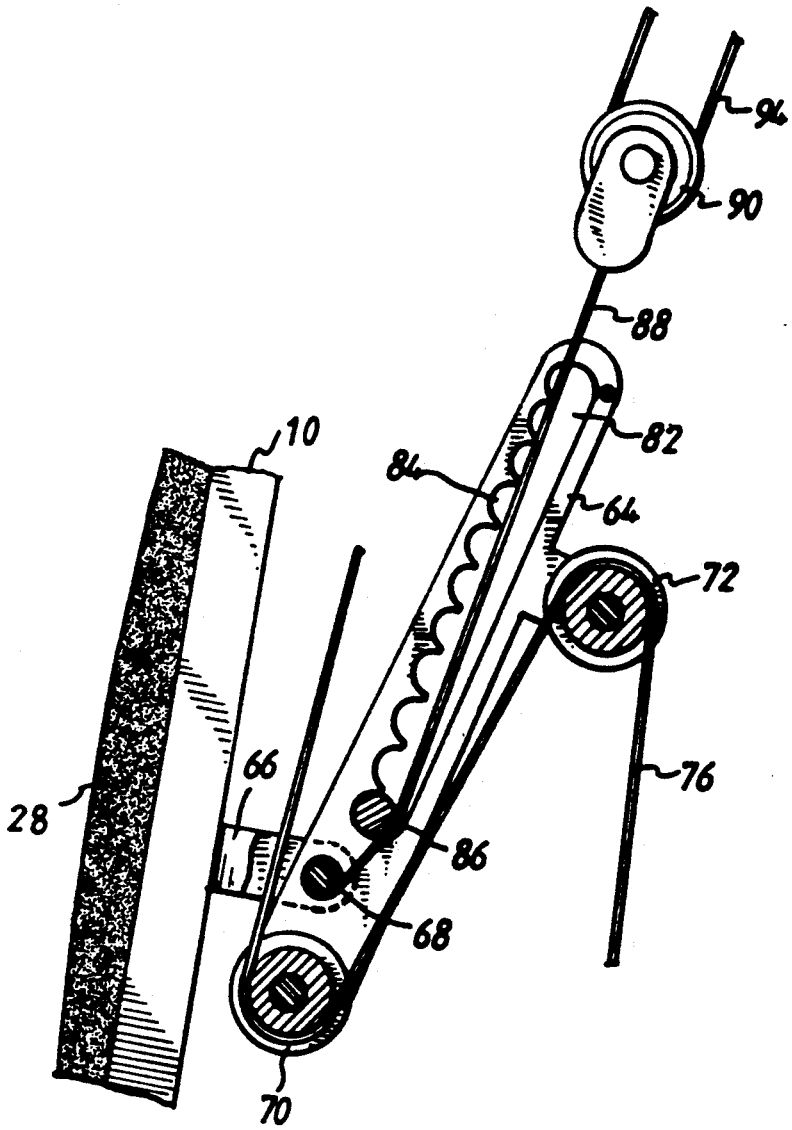
FIG. 6 is a cross-sectional view of the resistance-adjusting means.

Now with general reference to FIGS. 1 and 2 and with specific reference to FIGS. 5 and 6, the resistance-adjusting means generally comprises an elongated body portion 64 which is rotatably attached to the primary support 10 by means of a bracket 66 and an axle 68. An axis of rotation is defined by the axle 68, and it is preferable for the axis of rotation to be positioned in the body portion 64 so as to define moment arms of different length on either side thereof.

The resistance-adjusting means further comprises a moment means which is formed in the body portion 64 and adjusts a moment arm thereof. A first pulley 70 is attached to the body portion 64 at a lower end thereof, and a second pulley 72 is attached to the body portion 64 by means of a bracket at a position where the axis of rotation is therebetween and the first pulley 70.

The resistance-adjusting means still further comprises a linking means which is attached to the moment means, the top support 12, and the weight (the weight is designated by reference numeral 74, see FIGS. 1 and 2). The linking means draws the weight 74 upward as the body portion 64 rotates. A cable 76 is received on the first and the second pulley 70 and 72 and has one end thereof pivotally fixed to the upper bar 18 and the other end thereof pivotally fixed to the lower bar 30 at midpoints thereof.

The upper and the lower exercising means each further comprise a stopping means such as a blocking ball 78 disposed on the ends of the cable 76 (see FIG. 2). The blocking balls 78 prevent movement of the cable 76 at one of the exercising means when the other exercising means is being manipulated.

The moment means generally comprises a channel 80 formed through the body portion 64, thereby defining a pair of outer walls in a spaced relationship. A slot 82 is formed through each wall and has a plurality of notches 84 formed in one side thereof. A pin 86 is slidable in both the slots 82 and is simultaneously receivable in corresponding notches 84. A pliable strap 88 is fixed between the linking means and the axle 68 and is passable through the channel 80. The strap 88 contacting the pin 86 on a side away from the notches 84, thereby urging the pin 86 therein.

A moment arm is define by the distance between the pin 86 and the axis of rotation, i.e., the axle 68. When the pin 86 is received in corresponding notches 84 nearest the axle 86, the moment arm is defined as a shortest one such that a level of resistance is defined as a lowest one. And when the pin 86 is moved to and received in corresponding notches 84 farther away from the axle 68, the moment arm increases such that the level of resistance increases.

It should be known that the position of the axis of rotation, i.e., the axle 86, the position of the second pulley 72, the length of the body portion 64, the length of the slots 82, and the number of the notches 84 are discretionary depending upon the desired levels of resistance. That is, the moment arm, in conjunction with the weight 74, yields levels of resistance from a lowest desired level to a highest desired level with desired increments therebetween.

The linking means generally comprises a first pulley 90 which has a bracket formed therearound attached to strap 88. A second pulley 92 (see FIG. 2) is disposed on the top support at a rear end thereof. A cable 94 is received on the first and the second pulley 90 and 92 and has one end thereof fixed to the top support 12 and the other end thereof fixed to the weight 74. The linking means further comprises a guiding means which guides the weight 74 upward and downward. The guiding means comprises a pair of rods 96 which are fixed between the top support 12 and the bottom support 14 in a substantially vertical and spaced relationship. A pair of guide blocks 98 is fixed to the weight 74. Each guide block 98 is slidable around a rod 96, thereby stably guiding the weight 74.

As can be realized, when a user pulls on, for example, the upper bar 18, the stopping block 78 of the lower exercising means prevents the portion of the cable 76 below the second pulley 72 from moving, thereby the cable 76 exerts a force on the second pulley 72 such that the body portion 64 rotates about the axis of rotation. The body portion 64 urges the pin 86 to rotate therewith, and, consequently, the strap 88 moves with the body portion 64 through an angular distance. The strap 88 draws the first pulley 90 of the linking means downward, and, subsequently, the cable 94 is drawn downward, thereby drawing the weight 74 upward by means of the second pulley 92.

Likewise, when a user pulls on the lower bar 30, the stopping block 78 of the upper exercising means prevents the portion of the cable 76 above the first pulley 70 from moving, thereby the cable 76 exerts a force on the second pulley 72 such that the body portion 64 rotates about the axis of rotation. Subsequently, the weight 74 is drawing upward the same as above.

Finally in accordance with the present invention, reference needing to be made to FIGS. 1 and 2, the linking means of the pectoral exercising means comprises a first pair of pulleys 100 which is attached to the upper portion of the primary support 10, each pulley thereof corresponding to one of the butterfly bars 44; a second pair of pulleys 102 which are attached to each other in line and at 90 degrees, one pulley thereof being received on the cable 76 at a position between the second and the third lower pulley 34 and 36; and a linking cable 104 which is respectively fixed to the butterfly bars 44 at ends thereof (see FIG. 3) and received on the other pulley of the second pair of pulleys 102.

With further reference to FIG. 3, the linking means of the pectoral exercising means further comprises a pair of distancing means each of which is disposed on one of the butterfly bars 44 and maintains the linking cable 104 at a desired distance from the bottom of the main bar 42. Each distancing means comprises a curved bar 106 which is fixed to the butterfly bar 44 near the main bar 42 and at a desired distance therefrom. Each curved bar 106 is channeled for retaining the linking cable 104 thereon. The linking cable 104 is fixed to the curved bars 106 by any suitable means such as shown.

Figure 7:
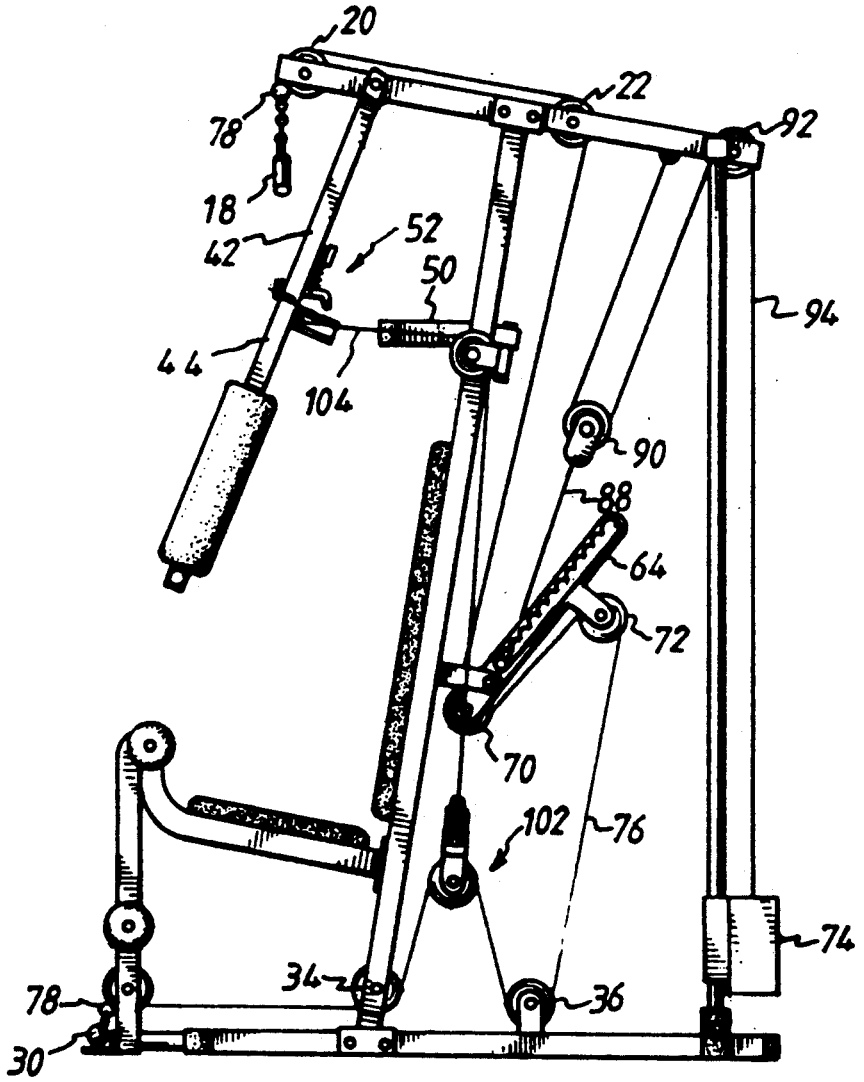
FIG. 7 is a view similar to FIG. 2, showing the manipulation of the pectoral exercising means.

With further reference to FIG. 7, the locking means is unlocked, i.e., the knob 56 is loosened, and the main bar 42 along with the butterfly bars 44 is pivoted outward. The linking cable 104 draws the second set of pulleys 102 upward, thereby drawing the portion of the cable 76 between the second and the third lower pulleys 34 and 36 upward. The stopping blocks 78 of the upper and the lower exercising means prevent the cable 76 from moving, thereby the body portion 64 must rotate to compensate. The weight 74 is subsequently drawn upward as previously described.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A multifunction exercise apparatus comprising:

a frame comprising a primary support with a top and a bottom, a top support attached to said top of said primary support, a floor support attached to said bottom of said primary support and at least one guide having a top attached to said top support and a bottom attached to said floor support, behind said primary support;

a weight comprising at least one passage through which said at least one guide projects so that said weight can be moved up and down along said guide;

a resistance adjusting assembly comprising:

a first cable having a first end attached to said weight and a second end attached to said top support and riding on a first pulley mounted on said top support and a second pulley rotating about an axle;

a strap having a first end attached to said axle and a second end attached to a shaft mounted on a brace attached to said primary support;

two connected slim plates each having (a) a hole through which said shaft projects so that said joined slim plates are permitted to rotate with respect to said primary support, (b) a number of notches and (c) a longitudinal slot communicating with said notches;

a pin received in a pair of said notches respectively formed in said slim plates, for contacting said strap;

a third pulley mounted on and between said slim plates so that said shaft is sited between said pin and said pulley;

a fourth pulley mounted on a brace attached to said slim plates so that said shaft is sited between said third and fourth pulleys; and a second cable riding on said third and fourth pulleys and having a first section riding on a fifth pulley mounted on said top support and a second section riding on a sixth pulley mounted on said floor support;

an upper exercising means communicating with said first section of said second cable;

a lower exercising means communicating with said second section of said second cable; and a pectoral exercising means comprising:

a main bar pivotally attached to said top support;

a pair of butterfly bars pivotally attached below said main bar;

a pair of seventh pulleys mounted on said primary support;

an eighth pulley attached, in line and at 90°, to a ninth pulley which is ridden on by said second cable; and a third cable riding on said eighth pulley and having two sections each riding on one of said seventh pulleys and communicating with one of said butterfly bars.

* * * * *